US009565937B1

(12) United States Patent
Jansen

(10) Patent No.: US 9,565,937 B1
(45) Date of Patent: Feb. 14, 2017

(54) BALL JOINT PINION FOR A DRAWER SLIDE ASSEMBLY

(71) Applicant: General Electric Company, Schenectady, NY (US)

(72) Inventor: Katherine Michelle Jansen, Louisville, KY (US)

(73) Assignee: Haier U.S. Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 14/868,453

(22) Filed: Sep. 29, 2015

(51) Int. Cl.
*F25D 25/00* (2006.01)
*A47B 88/04* (2006.01)
*F25D 25/02* (2006.01)

(52) U.S. Cl.
CPC ..... *A47B 88/04* (2013.01); *F25D 25/025* (2013.01); *A47B 2210/0078* (2013.01)

(58) Field of Classification Search
CPC ... F25D 25/025; A47B 88/04; A47B 88/0418; A47B 88/0422; A47B 2210/007; A47B 2210/175
USPC ..... 312/331, 402
See application file for complete search history.

(56) References Cited

U.S. PATENT DOCUMENTS 8,360,539 B2 1/2013 Brown et al.
8,960,820 B2 * 2/2015 Chen ..... A47B 88/04 312/331
2009/0322470 A1 * 12/2009 Yoo ..... A47B 88/0414 340/3.1
2010/0283365 A1 * 11/2010 Chen ..... A47B 88/14 312/334.4
2011/0210655 A1 * 9/2011 Brown ..... A47B 88/04 312/334.8
2012/0125035 A1 * 5/2012 Chellappan ..... F25D 25/025 62/340

FOREIGN PATENT DOCUMENTS

KR 101299064 B1 8/2013

* cited by examiner

*Primary Examiner* — Daniel Rohroff
(74) *Attorney, Agent, or Firm* — Dority & Manning, P.A.

(57) ABSTRACT

A drawer assembly for a consumer appliance is provided. The drawer assembly includes an anti-racking system for minimizing misalignment of an appliance drawer. More particularly, the present subject matter provides a drawer slide assembly for a drawer having some horizontal flexibility. The drawer slide assembly may have a pinion gear and connecting rod assembly that minimizes racking of the appliance drawer as it is moved into and out an appliance chamber. The appliance drawer may be attached to the appliance chamber by a ball and joint pinion gear configuration that adds another degree of freedom to the anti-racking system in order to reduce stress on the pinion gear. By adding an additional degree of freedom to the pinion gear and reducing the imposed stresses applied to the pinion gear, the performance and lifetime of the drawer assembly may be improved.

20 Claims, 16 Drawing Sheets

BALL JOINT PINION FOR A DRAWER SLIDE ASSEMBLY

FIELD OF THE INVENTION

The present subject matter relates generally to appliances, such as refrigerator appliances, and drawer assemblies for the same.

BACKGROUND OF THE INVENTION

Various types of consumer appliances are designed with pull-out compartment drawers. For example, a number of popular refrigerator styles have freezer compartments with one or more pull-out drawers that span the width of the appliance and include storage baskets or bins. The conventional pull-out drawers typically include side brackets that are mounted to slides of a slide mechanism that, in turn, has a base member mounted to the compartment liner.

Due to their substantial width, depth, and weight, the pull-out drawers are susceptible to misalignment between the sides when moving the drawer into and out of the appliance compartment, particularly if the door is grasped off-center and the pulling/closing force is applied non-parallel to the slide structure. This misalignment may lead to binding or "racking" of the drawer, which may make further movement of the drawer difficult and may also lead to an improper seal of the drawer in the closed position.

A known approach to minimize racking of the drawers is to synchronize the sliding movement of the opposite drawer slide assemblies with a pinion gear and connecting rod assembly. A pinion gear is provided at each side of the drawer that engages with a stationary gear rail as the drawer moves in and out of the freezer compartment. The pinion gears are connected with a connecting rod that spans the width of the drawer. The connecting rod synchronizes movement of the respective pinion gears along the gear rail, which is imparted to the drawer slide assemblies. Thus, any off-center pulling/pushing force on the drawer handle is compensated for through the connecting rod and pinion gears.

Although the pinion gear and connecting rod assembly discussed above is beneficial in minimizing the occurrence of racking, the pinion gears may be subjected to substantial forces and stresses during operation. For example, axial, transverse, and torsional forces are imparted on the pinion gears during operation, which may lead to pinion gear failure. Particularly when the drawer has any horizontal flexibility, torsional forces may place excessive stress on the pinion gears and cause premature failure.

Accordingly, a refrigerator appliance including an improved drawer assembly would be useful. More particularly, a drawer slide assembly having an anti-racking system with a pinion gear designed to withstand stresses commonly experienced during operation would be especially beneficial.

BRIEF DESCRIPTION OF THE INVENTION

The present subject matter provides a drawer assembly for a consumer appliance having an anti-racking system for minimizing misalignment of an appliance drawer. More particularly, the present subject matter provides a drawer slide assembly for a drawer having some horizontal flexibility. The drawer slide assembly may have a pinion gear and connecting rod assembly that minimizes racking of the appliance drawer as it is moved into and out an appliance chamber. The appliance drawer may be attached to the appliance chamber by a ball and joint pinion gear configuration that adds another degree of freedom to the anti-racking system in order to reduce stress on the pinion gear. By adding an additional degree of freedom to the pinion gear and reducing the stresses imposed on the pinion gear, the performance and lifetime of the drawer assembly may be improved. Additional aspects and advantages of the invention will be set forth in part in the following description, or may be apparent from the description, or may be learned through practice of the invention.

In a first exemplary embodiment, a drawer assembly for a consumer appliance that defines a cabinet having a first sidewall and a second sidewall is provided. The drawer assembly includes a first support mounted to the first sidewall and having a first geared rack, and a second support mounted to the second sidewall and having a second geared rack. A drawer door includes a first drawer slide and a second drawer slide, a first end of each of the first drawer slide and the second drawer slide being attached to the drawer door. A first pinion base is attached at a second end of the first drawer slide and defines a first pinion stud, and a second pinion base is attached at a second end of the second drawer slide and defines a second pinion stud. A first pinion gear engages the first geared rack and defines a first socket that is configured to receive the first pinion stud and rotatably mount the first pinion gear to the first pinion base, and a second pinion gear engages the second geared rack and defines a second socket that is configured to receive the second pinion stud and rotatably mount the second pinion gear to the second pinion base. A connecting rod connects the first pinion gear and the second pinion gear, such that driving force generated at the first pinion gear from an off-center pulling force on the drawer door is transmitted through the connecting rod to the second pinion gear as the drawer door moves between an open and a closed position.

According to another exemplary embodiment, a consumer appliance is provided. The consumer appliance includes a compartment having a first side and an opposite second side. A first slide member is configured on the first side of the compartment and a second slide member is configured on the second side of the compartment. A first gear rail is configured adjacent the first slide member and a second gear rail is configured adjacent the second slide member. A drawer mounted to the first slide member and the second slide member for movement of the drawer into and out of the compartment. A first gear assembly is mounted to the first slide member and a second gear assembly is mounted to the second slide member, each of the first gear assembly and the second gear assembly including a pinion base that is attached to the respective first slide member or second slide member and defines a pinion stud, and a pinion gear defining a socket that is configured to receive the pinion stud such that the pinion gear is rotatably mounted to the pinion base. Each pinion gear engages the respective first gear rail or second gear rail and a cross bar is connected between the pinion gears such that driving force generated at the first gear assembly from an off-center pulling force on the drawer is transmitted through the cross bar to the second gear assembly.

According to still another exemplary embodiment, a consumer appliance is provided. The consumer appliance defines a vertical direction, a lateral direction, and a transverse direction, the vertical, lateral, and transverse directions being mutually perpendicular. The consumer appliance includes a compartment having a first side portion and a second side portion spaced apart from each other along the lateral direction, and a first slide assembly base proximate the first side portion and including a first geared rack, and a second slide assembly base proximate the second side portion and comprising a second geared rack. A drawer is configured to provide access into the compartment, the drawer having a first slide assembly positioned proximate the first slide assembly base and a second slide assembly positioned proximate the second slide assembly base. A first pinion gear assembly is mounted to the first slide assembly and a second pinion gear assembly is mounted to the second slide assembly, each of the first pinion gear assembly and the second pinion gear assembly including a pinion base that defines a spherical ball stud, and a pinion gear defining a socket that is configured to receive the spherical ball stud. Each pinion gear engages the respective first geared rack or second geared rack and a cross bar is connected between the pinion gears such that driving force generated at the first pinion gear assembly from an off-center pulling force on the drawer is transmitted through the cross bar to the second pinion gear assembly. The first slide assembly and the second slide assembly support the drawer such that the drawer is translatable along the transverse direction between an open position where it is disposed outside of the compartment and a closed position where it is disposed inside the compartment.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
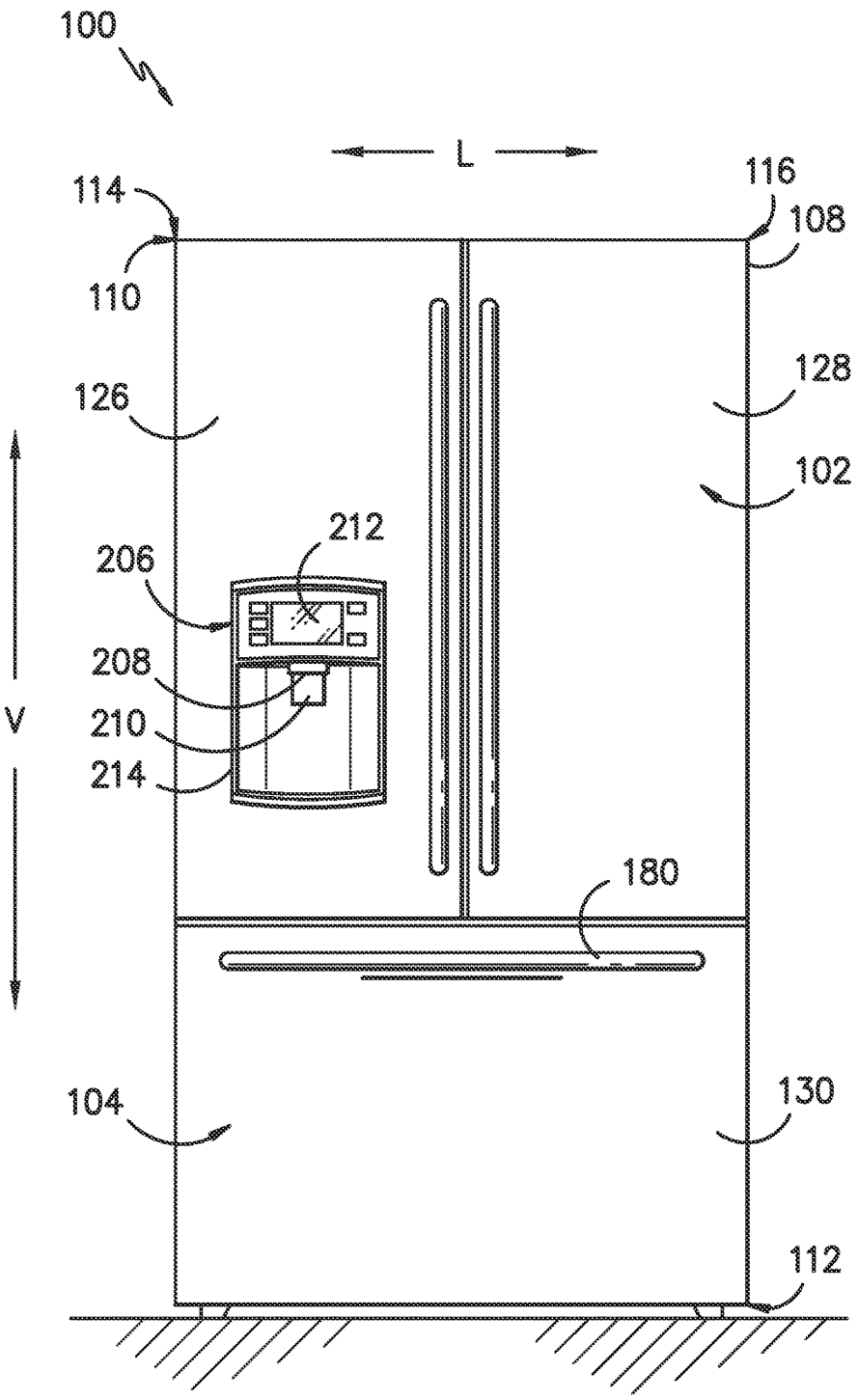
FIG. 1 provides a front elevation view of a refrigerator appliance according to an exemplary embodiment of the present subject matter with doors and a freezer drawer shown in the closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
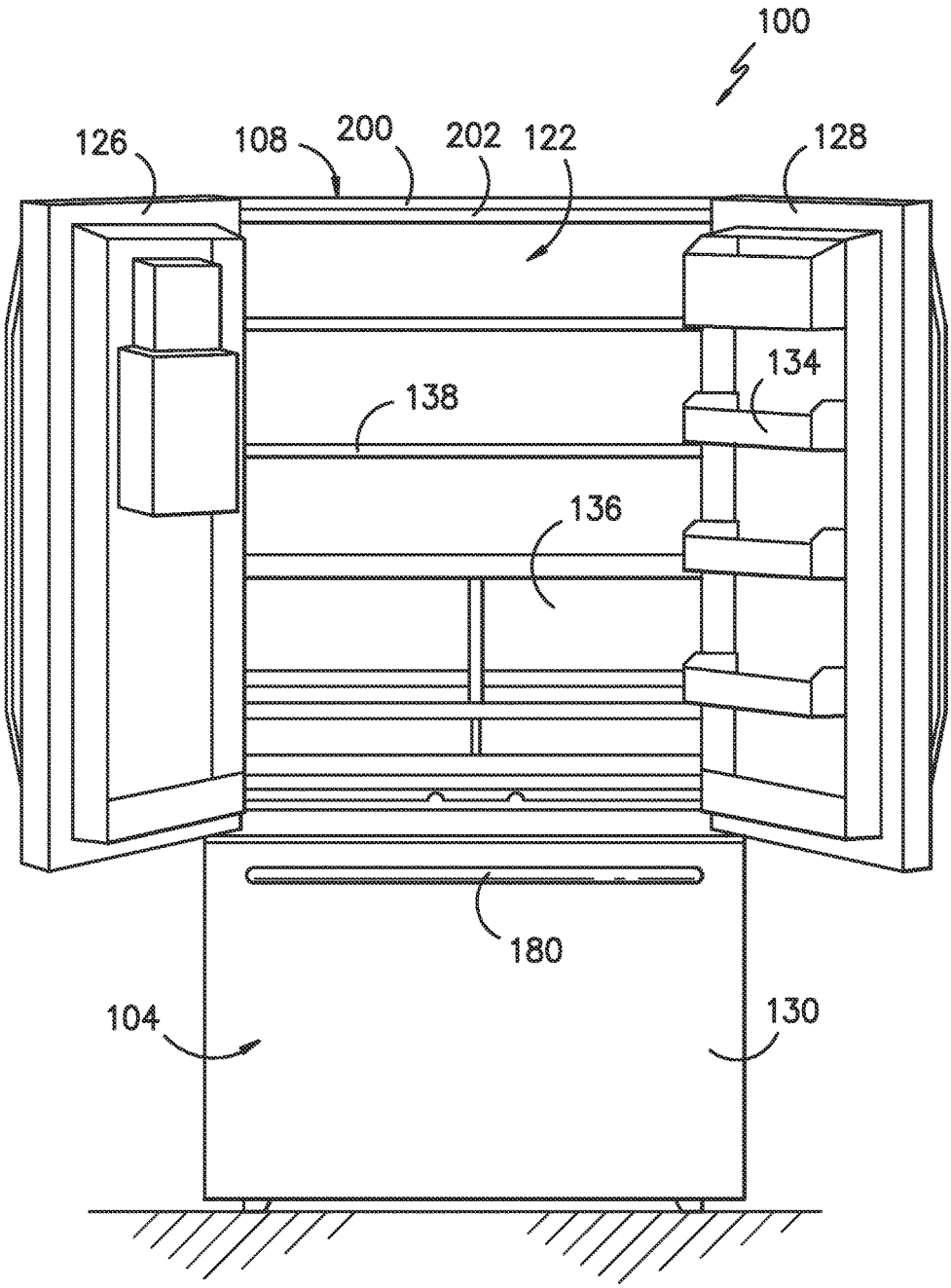
FIG. 2 provides a front elevation view of the exemplary refrigerator appliance of FIG. 1 with the doors shown in an open position.

FIG. 1 provides a front, elevation view of a refrigerator appliance 100 according to an exemplary embodiment of the present subject matter with refrigerator doors 102 and freezer drawer 104 of the refrigerator appliance 100 shown in a closed position. FIG. 2 provides a front, elevation view of refrigerator appliance 100 with refrigerator doors 102 and freezer drawer 104 of refrigerator appliance 100 shown in an open position. Refrigerator appliance 100 defines a vertical direction V, a lateral direction L, and a transverse direction T (see, e.g., FIG. 3), each mutually perpendicular to one another. As discussed in greater detail below, refrigerator appliance 100 includes features for assisting with accessing food items stored therein.

Figure 3:
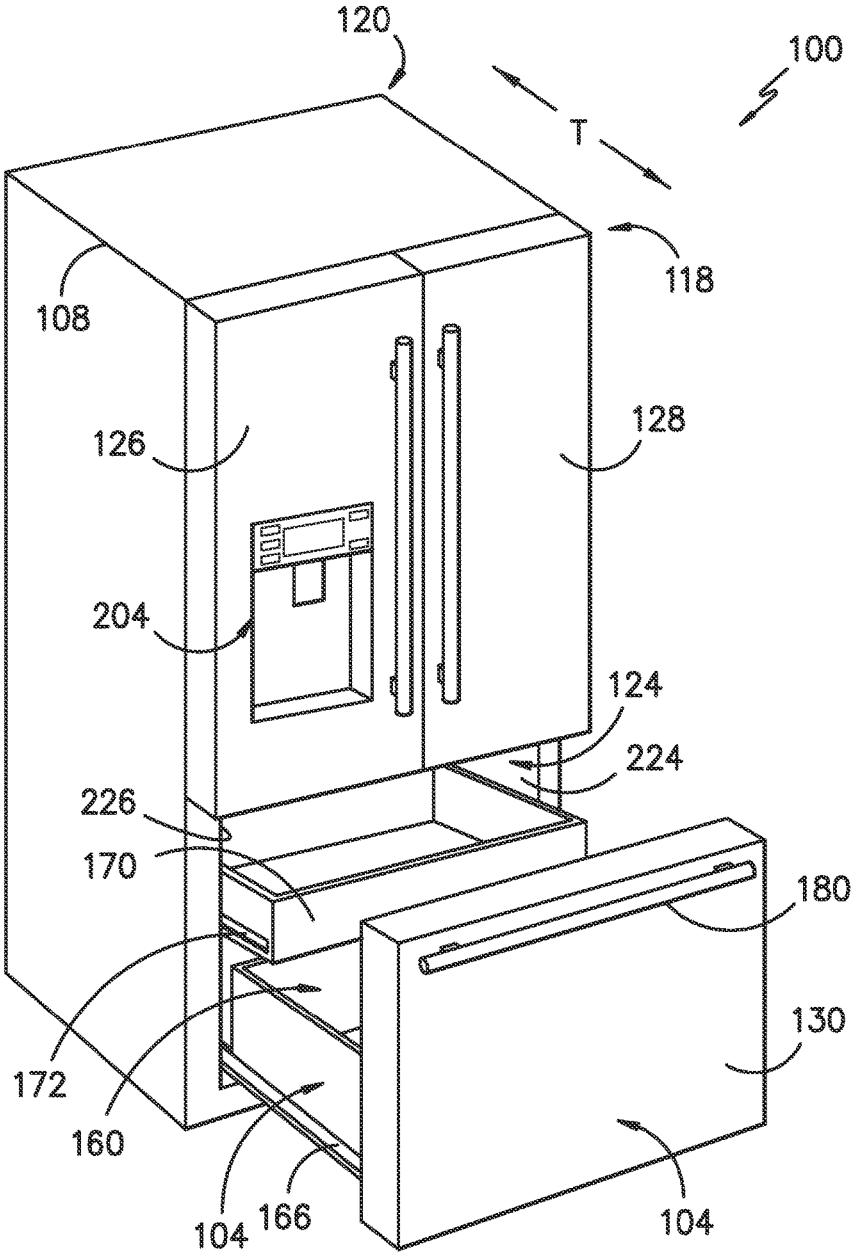
FIG. 3 provides a perspective view of the exemplary refrigerator appliance of FIG. 1 with the freezer drawer in the open position.
Figure 4:
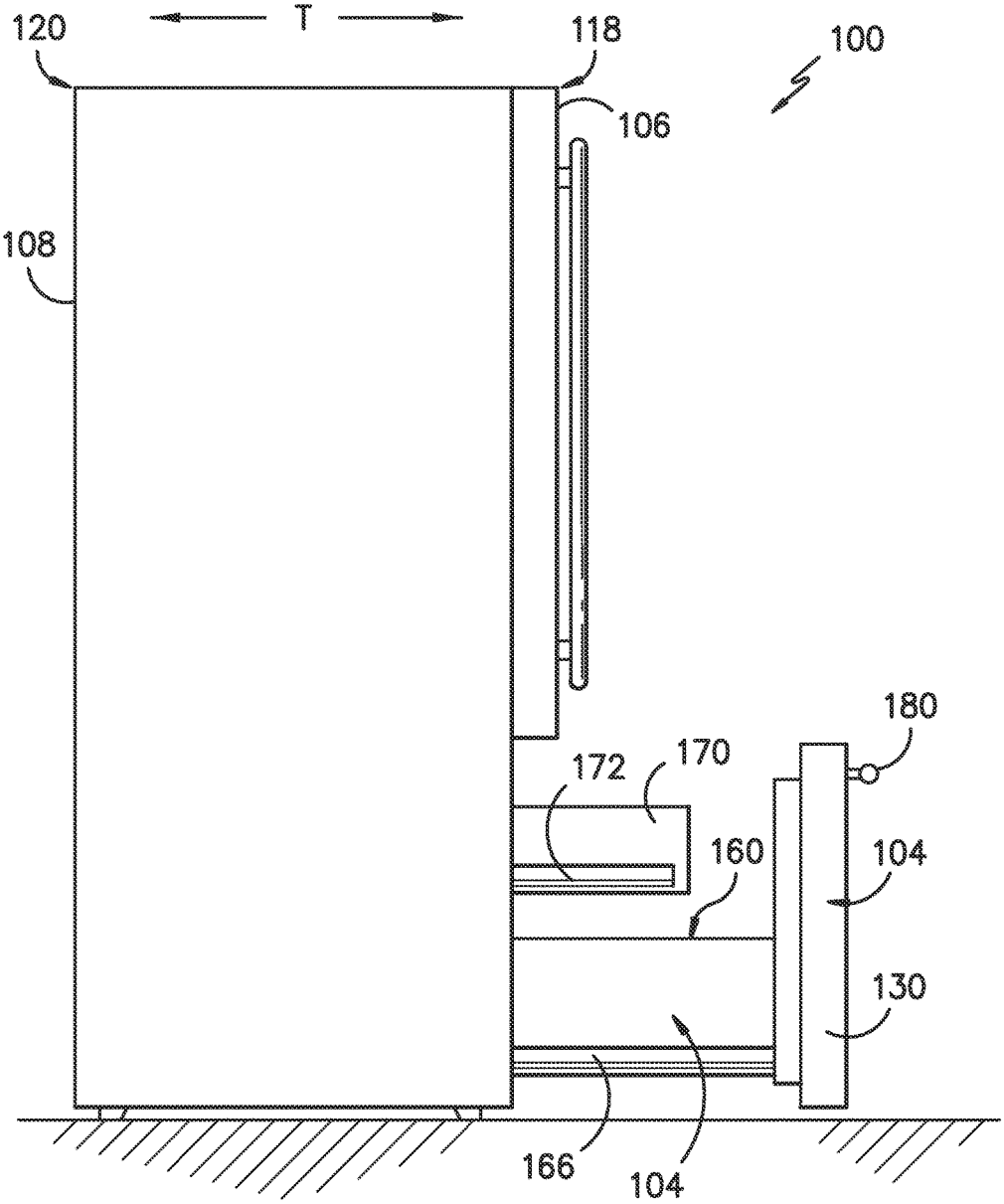
FIG. 4 provides a side view of the exemplary refrigerator appliance of FIG. 1 with the freezer drawer in the open position.

As may be seen in FIGS. 1, 2 and 3, refrigerator appliance 100 includes a housing or cabinet 108 that extends between a top 110 and a bottom 112 along the vertical direction V, between a first side 114 and a second side 116 along the lateral direction L, and between a front side 118 and a rear side 120 along the transverse direction T (see, e.g., FIG. 3).

As depicted, cabinet 108 defines chilled chambers for receipt of food items for storage. In particular, cabinet 108 defines fresh food chamber 122 (FIG. 2) positioned at or adjacent top 110 of cabinet 108 and a freezer chamber 124 (FIG. 3) arranged at or adjacent bottom 112 of cabinet 108.

As such, refrigerator appliance 100 is generally referred to as a bottom mount refrigerator. It is recognized, however, that the benefits of the present disclosure apply to other types and styles of refrigerators such as, for example, a top mount refrigerator, a side-by-side style refrigerator, or a freezer appliance. Consequently, the description set forth herein is for illustrative purposes only and is not intended to be limiting in any aspect to a particular refrigerator chamber configuration. Moreover, aspects of the present subject matter may be used for any appliance with a drawer requiring a drawer slide assembly exhibiting improved performance and durability.

Refrigerator doors 102 are rotatably mounted to cabinet 108, e.g., such that doors 102 permit selective access to fresh food chamber 122 of cabinet 108. As shown in the illustrated embodiment, refrigerator doors 102 include a first refrigerator door 126 rotatably mounted to cabinet 108 at first side 114 of cabinet 108 and a second refrigerator door 128 rotatably mounted to cabinet 108 at second side 116 of cabinet 108.

In addition, a freezer drawer 104 is arranged below refrigerator doors 102 for selectively accessing items stored in freezer chamber 124. As discussed in greater detail below, freezer drawer 104 is slidably mounted to cabinet 108 and can be selectively moved in and out of freezer chamber 124 along transverse direction T. Freezer drawer 104 may further include a front panel 130 which may be attached to the freezer drawer 104 and may define a front surface that sits flush with a front surface of the refrigerator doors 126, 128 when in the closed position.

Referring specifically to FIG. 2, various storage components are mounted within fresh food chamber 122 to facilitate storage of food items therein as will be understood by those skilled in the art. In particular, the storage components include bins 134, drawers 136, and shelves 138 that are mounted within fresh food chamber 122. Bins 134, drawers 136, and shelves 138 are configured for receipt of food items (e.g., beverages and/or solid food items) and may assist with organizing such food items. As an example, drawers 136 can receive fresh food items (e.g., vegetables, fruits, and/or cheeses) and increase the useful life of such fresh food items.

Similarly, a variety of support baskets, bins, drawers, or other containers may be received within freezer chamber 124 for receipt and storage of food items in freezer chamber 124. For example, as shown in FIG. 3, a freezer drawer 104 may define a storage volume 160, e.g., for receipt of food items for storage. Freezer drawer 104 may shift between the open and closed positions in order to access storage volume 160 by sliding freezer drawer 104 along the transverse direction T. In this regard, as will be discussed in detail below, the freezer drawer 104 may include a first drawer slide assembly 164 and a second drawer slide assembly 166, which are mounted on opposing sides of the freezer drawer 104 and are configured to allow the freezer drawer 104 to slide into and out of freezer chamber 124.

Also shown in FIG. 3, the refrigerator appliance 100 may further comprise a secondary bin 170 that is slidably mounted within freezer chamber 124. In this regard, secondary bin 170 may have its own set of drawer slides 172. However, in an alternative embodiment, secondary bin 170 may sit within a track on the top of freezer drawer 104. For example, secondary bin 170 may have a set of wheels that rolls along a top side of freezer drawer 104. In this manner, secondary bin 170 may move relative to freezer drawer 104 when freezer drawer 104 is in the open position. Thus, when freezer drawer 104 is open, secondary bin 170 may remain in freezer chamber 124 or may be extended along with freezer drawer 104. Other secondary bin 170 configurations are also possible.

The exemplary embodiment of freezer drawer 104 shown in FIG. 2 is provided by way of example only. Other configurations for freezer drawer 104 are within the scope of the present subject matter. For example, although the illustrated embodiment shows one freezer drawer 104 and one secondary bin 170, one skilled in the art will appreciate that more or fewer bins and drawers may be used if desired, and these bins and drawers can be configured as needed depending on the application. Also, freezer drawer 104 and secondary bin 170 may have any suitable size. For example, freezer drawer 104 may span across freezer chamber 124. Similarly, multiple drawer assemblies (e.g., two, three, or more) may be disposed within freezer chamber 124 in any suitable configuration.

Refrigerator doors 102 and freezer drawer 104 may be moved between the open and closed position using a variety of hand grips and/or handles. For example, freezer drawer 104 may include a handle 180 defined by or on front panel 130 of freezer drawer 104. A user can pull on handle 180 to adjust freezer drawer 104 between a closed position (FIG. 1) and an open position (FIG. 2). In the closed position, freezer drawer 104 closes access to freezer chamber 124 within cabinet 108. Conversely, freezer drawer 104 permits access to freezer chamber 124 within cabinet 108 when freezer drawer 104 is in the open position. With freezer drawer 104 in the closed position shown in FIG. 1, a user can grab handle 180 and pull freezer drawer 104 outwardly along the transverse direction T in order to slide freezer drawer 104 into the open position shown in FIGS. 2-3, thereby providing access to the storage volume 160 and allowing a user to insert food items therein.

Although the illustrated embodiment depicts handle 180 for opening and closing freezer drawer 104, one skilled in the art will appreciate that other handle configurations, such as pocket handles may be used to open and close the refrigerator doors 102 and freezer drawer 104. Pocket handles are generally integral to the door and are created by forming a recess in a door body. For example, a hand grip recess may be created on the side or front surface of a door, thereby allowing a user to manipulate the door. Pocket handles may be, for example, recessed portions in the top of front panel 130 of freezer drawer 104, where the user can insert one or more fingers to grip and pull the freezer drawer 104 to the open position.

The cabinet 108, refrigerator doors 102, and freezer drawer 104 of refrigerator appliance 100 can be constructed in any suitable manner. For example, cabinet 108 may include an outer case 200 and an inner liner 202. Outer case 200 and inner liner 202 are components of cabinet 108 and are assembled together to form cabinet 108. Outer case 200 is exposed such that outer case 200 can correspond to an outermost layer of cabinet 108. Outer case 200 may be formed by folding a sheet of a suitable material, such as stainless steel or painted steel, into an inverted U-shape to form top and side walls of outer case 200. Inner liner 202 is positioned within outer case 200 and defines fresh food chamber 122 and freezer chamber 124 of cabinet 108. Inner liner 202 can be formed from any suitable material, such as molded plastic. Insulating material (not shown), such as rigid polyurethane foam, is disposed between outer case 200 and inner liner 202 in order to insulate fresh food chamber 122 and freezer chamber 124 and provide structural rigidity for cabinet 108. The refrigerator doors 102 and freezer drawer 104 may be similarly constructed. For example, freezer drawer 104 may have an outer casing 200, insulating material (not shown), and inner liner 202. In addition, the inner liner 202 may be configured to receive a variety of trays, bins, shelves, and other support structures such as those discussed above.

Refrigerator appliance 100 also includes a dispensing assembly 204 for dispensing liquid water and/or ice. Dispensing assembly 204 includes a dispenser 206 positioned on or mounted to an exterior portion of refrigerator appliance 100, e.g., on one of the refrigerator doors 126, 128. Dispenser 206 includes a discharging outlet 208 for accessing ice and liquid water. An actuating mechanism 210, shown as a paddle, is mounted below discharging outlet 208 for operating dispenser 206. In alternative exemplary embodiments, any suitable actuating mechanism may be used to operate dispenser 206. For example, dispenser 206 can include a sensor (such as an ultrasonic sensor) or a button rather than the paddle. A user interface panel 212 is provided for controlling the mode of operation. For example, user interface panel 212 includes a plurality of user inputs (not labeled), such as a water dispensing button and an ice-dispensing button, for selecting a desired mode of operation such as crushed or non-crushed ice.

Discharging outlet 208 and actuating mechanism 210 are an external part of dispenser 206 and are mounted in a dispenser recess 214. Dispenser recess 214 is positioned at a predetermined elevation convenient for a user to access ice or water and enabling the user to access ice without the need to bend-over and without the need to open refrigerator doors 130, 132. In the exemplary embodiment, dispenser recess 214 is positioned at a level that approximates the chest level of a user.

Operation of the refrigerator appliance 100 can be regulated by a controller (not shown) that is operatively coupled to user interface panel 212. In response to user manipulation of the user interface panel 212, the controller operates various components of the refrigerator appliance 100. The controller may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor.

The controller may be positioned in a variety of locations throughout refrigerator appliance 100. In the illustrated embodiment, the controller may be located within the control panel area of the refrigerator doors 130, 132. In such an embodiment, input/output ("I/O") signals may be routed between the controller and various operational components of refrigerator appliance 100. In one embodiment, the user interface panel 212 may represent a general purpose I/O ("GPIO") device or functional block. In one embodiment, the user interface 212 may include input components, such as one or more of a variety of electrical, mechanical or electro-mechanical input devices including rotary dials, push buttons, and touch pads. The user interface 212 may include a display component, such as a digital or analog display device designed to provide operational feedback to a user. The user interface 212 may be in communication with the controller via one or more signal lines or shared communication busses.

Figure 5:
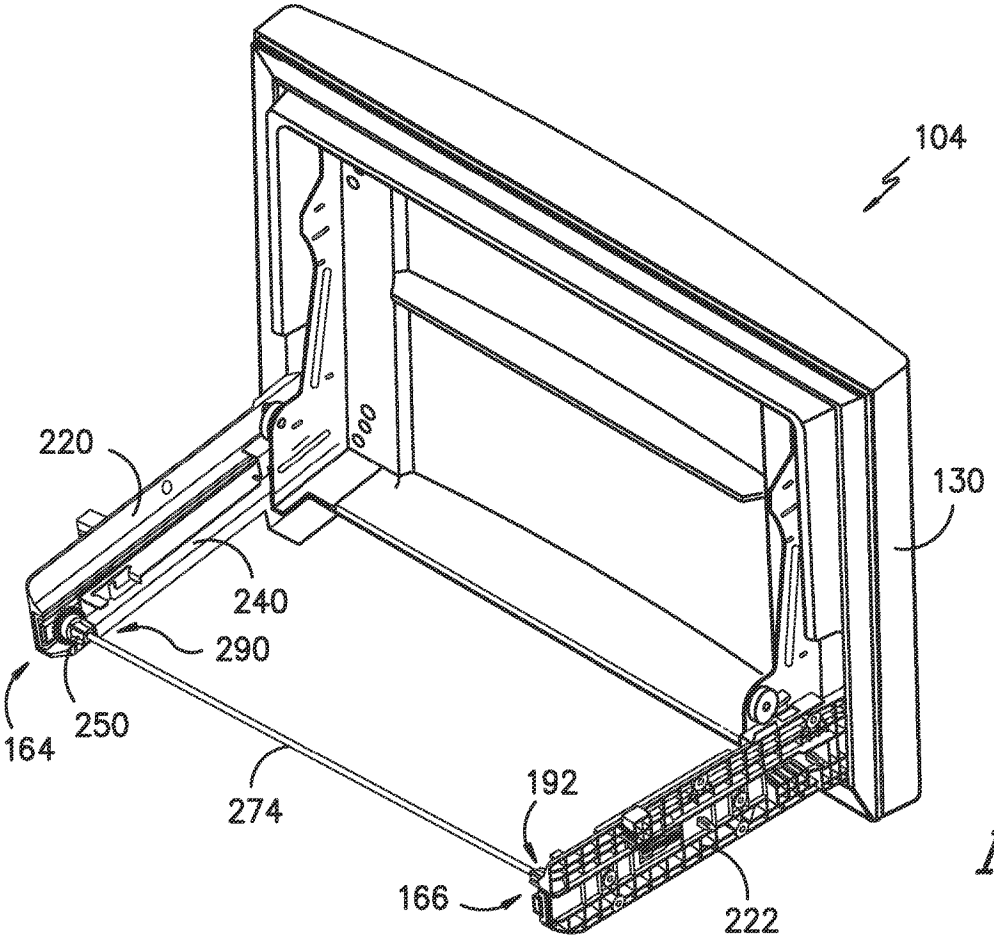
FIG. 5 provides a perspective view of the back side of the assembled freezer drawer and a drawer slide assembly of the exemplary refrigerator appliance of FIG. 1
Figure 6:
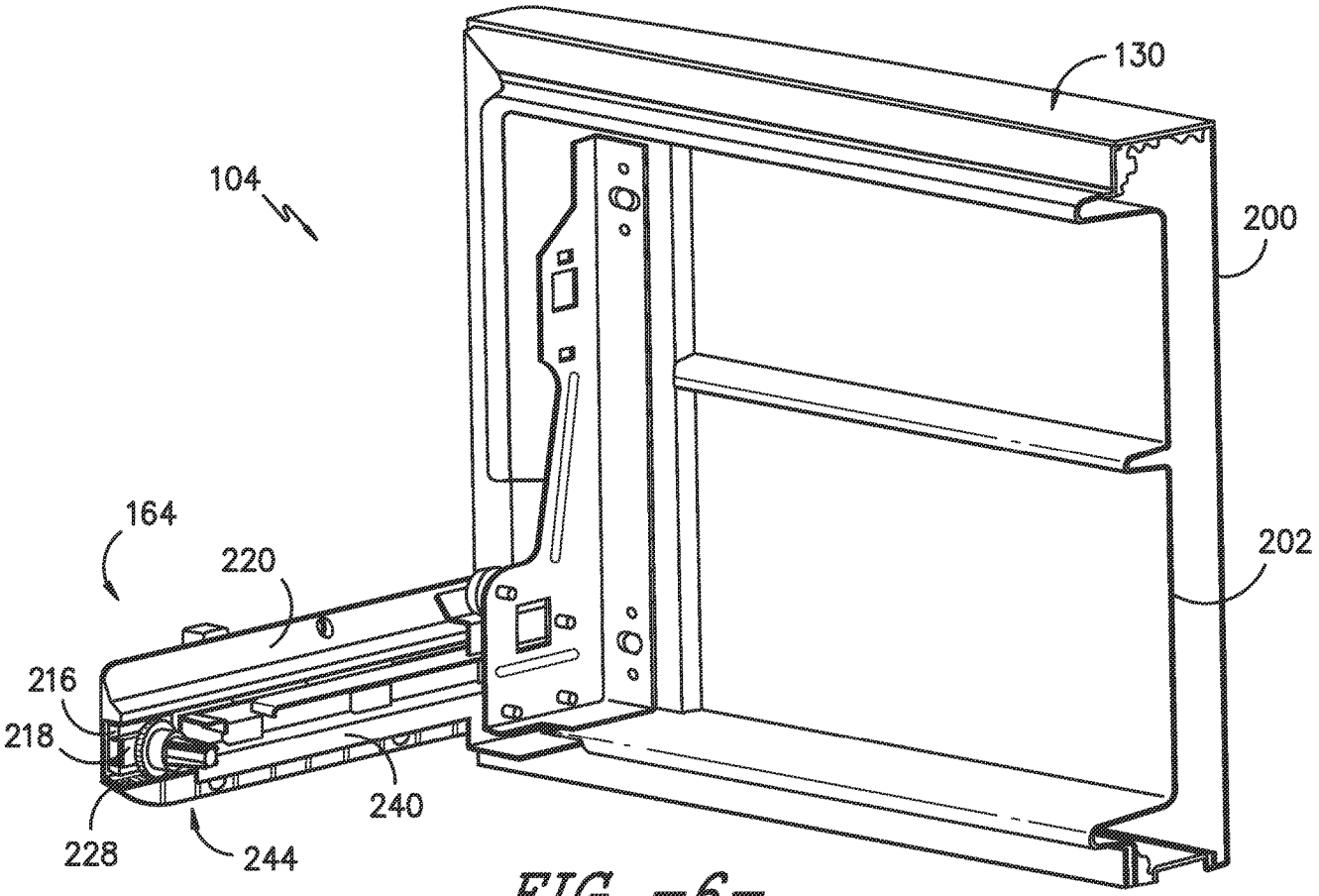
FIG. 6 provides a partial perspective view of the back side of the freezer drawer and the drawer slide assembly of the exemplary refrigerator appliance of FIG. 1.
Figure 7:
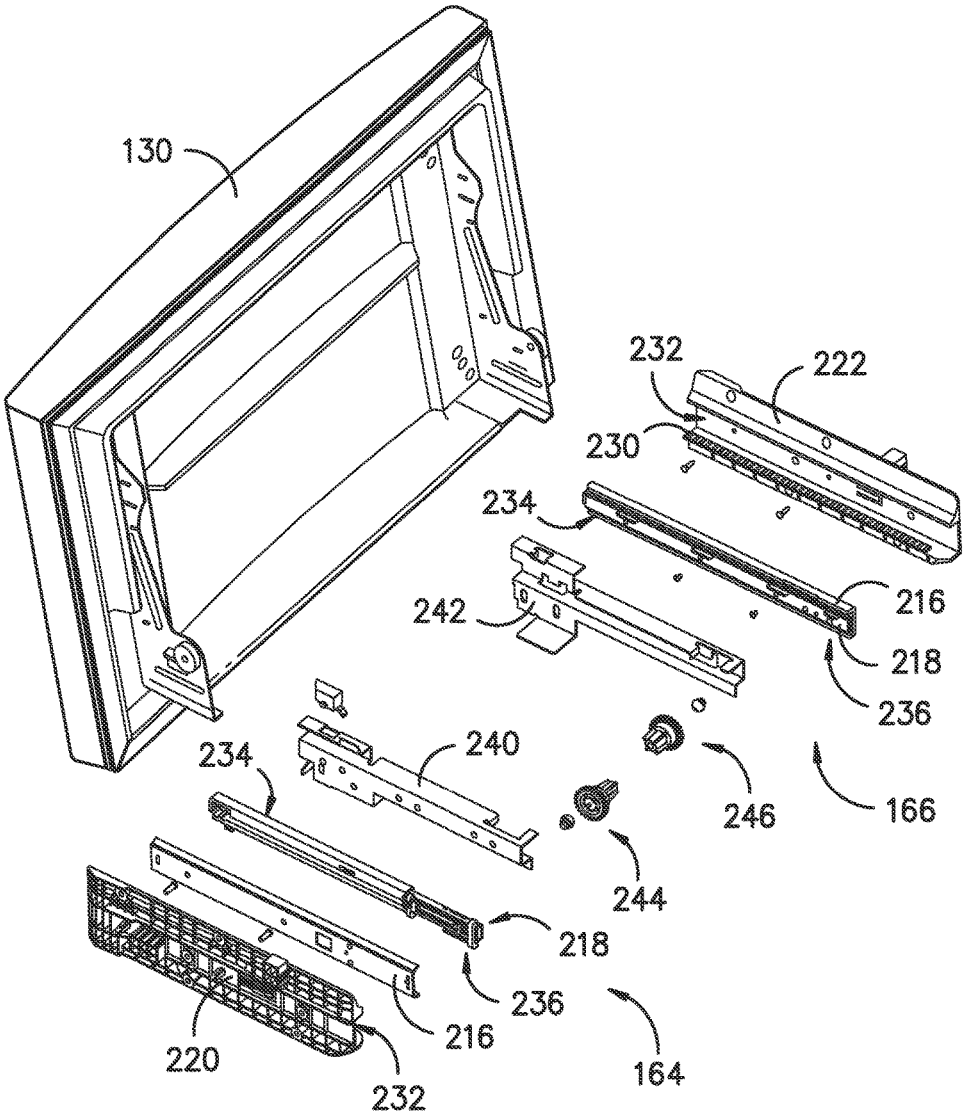
FIG. 7 provides an exploded view of the back side of the freezer drawer and the drawer slide assembly of the exemplary refrigerator appliance of FIG. 1.
Figure 8:
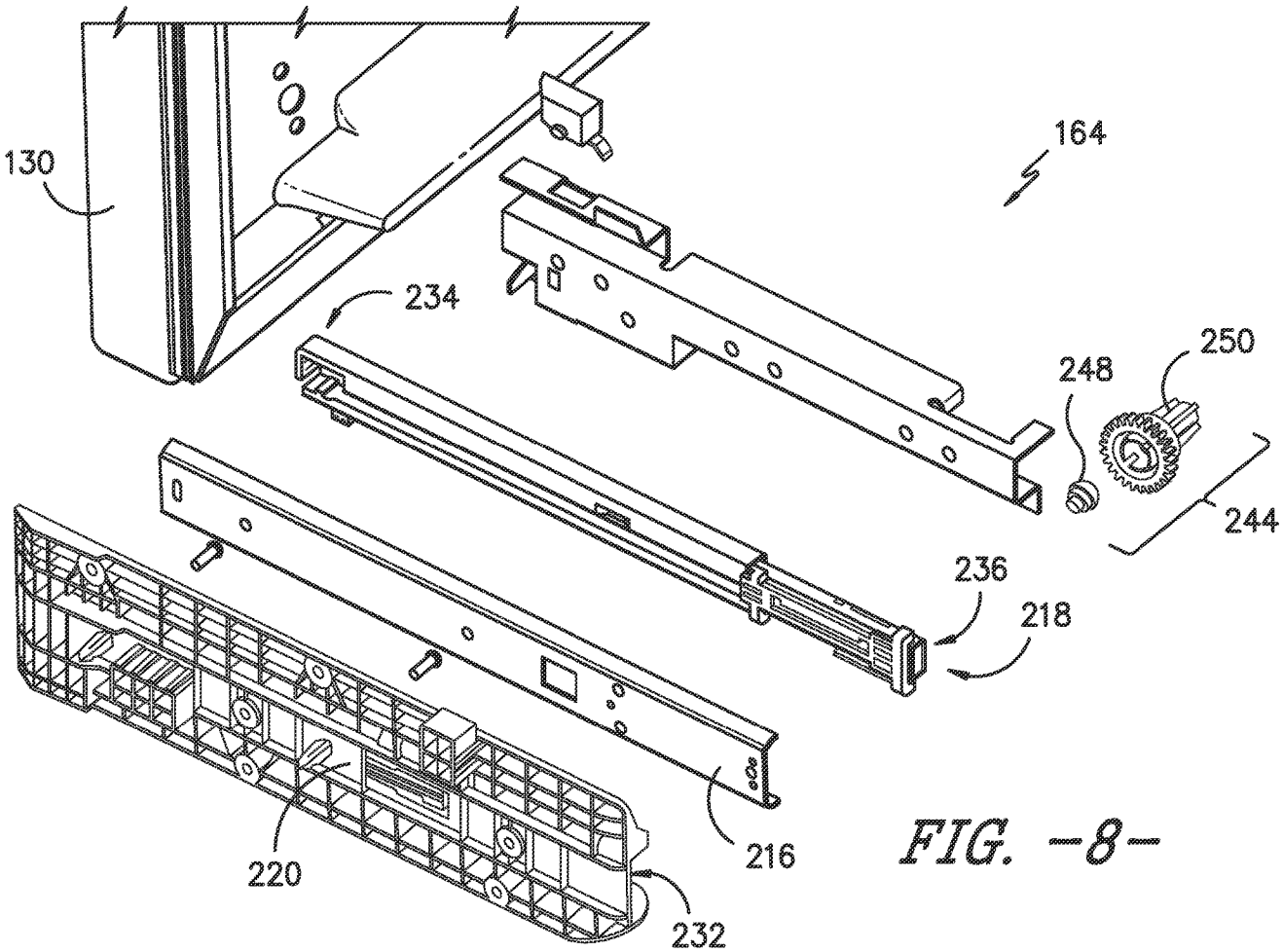
FIG. 8 provides a close-up exploded view of a first drawer slide assembly of the exemplary refrigerator appliance of FIG. 1.
Figure 9:
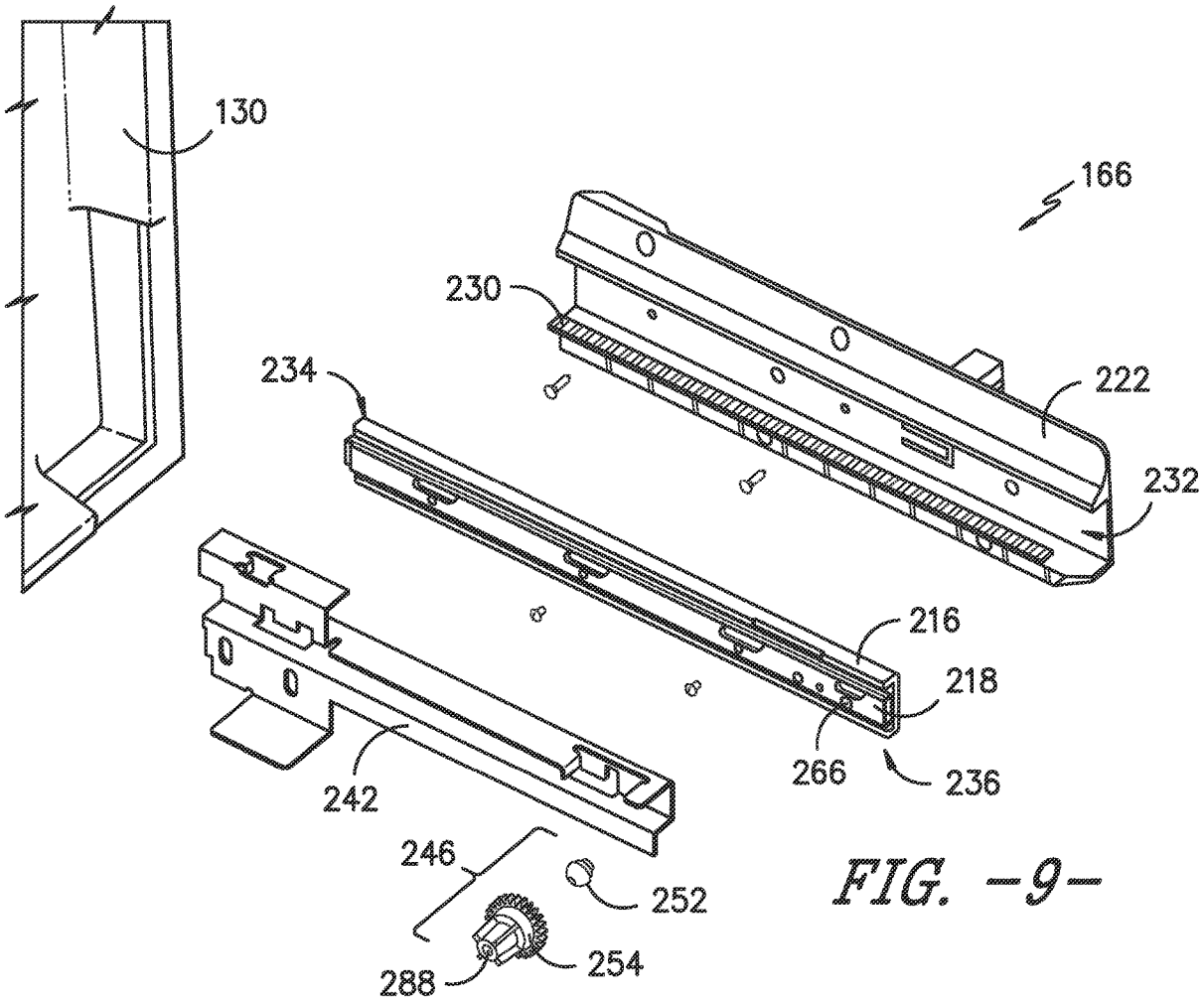
FIG. 9 provides a close-up exploded view of a second drawer slide assembly of the exemplary refrigerator appliance of FIG. 1.
Figure 10:
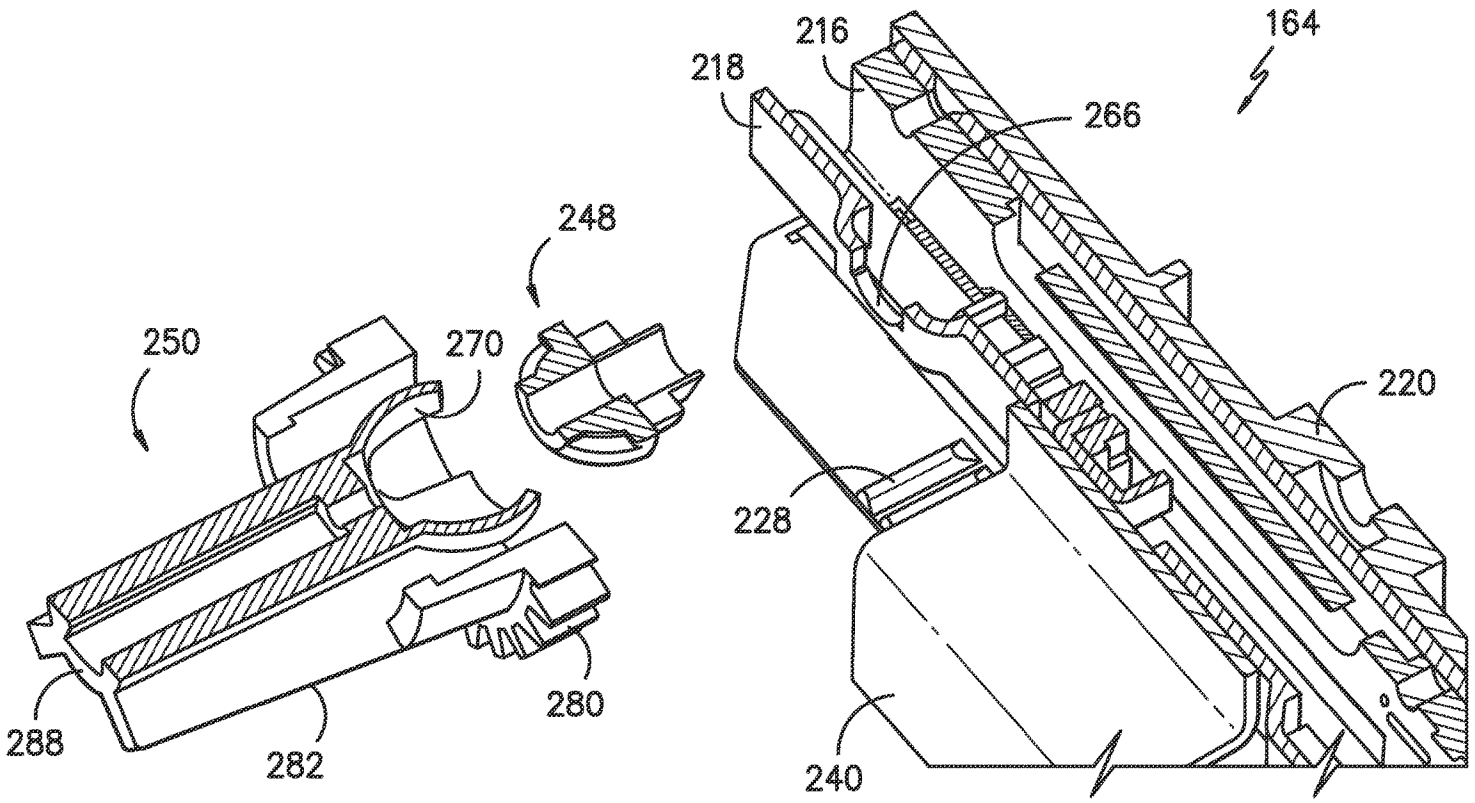
FIG. 10 provides an exploded, cross-sectional view of a pinion gear assembly and drawer slide assembly of the exemplary refrigerator appliance of FIG. 1.
Figure 11:
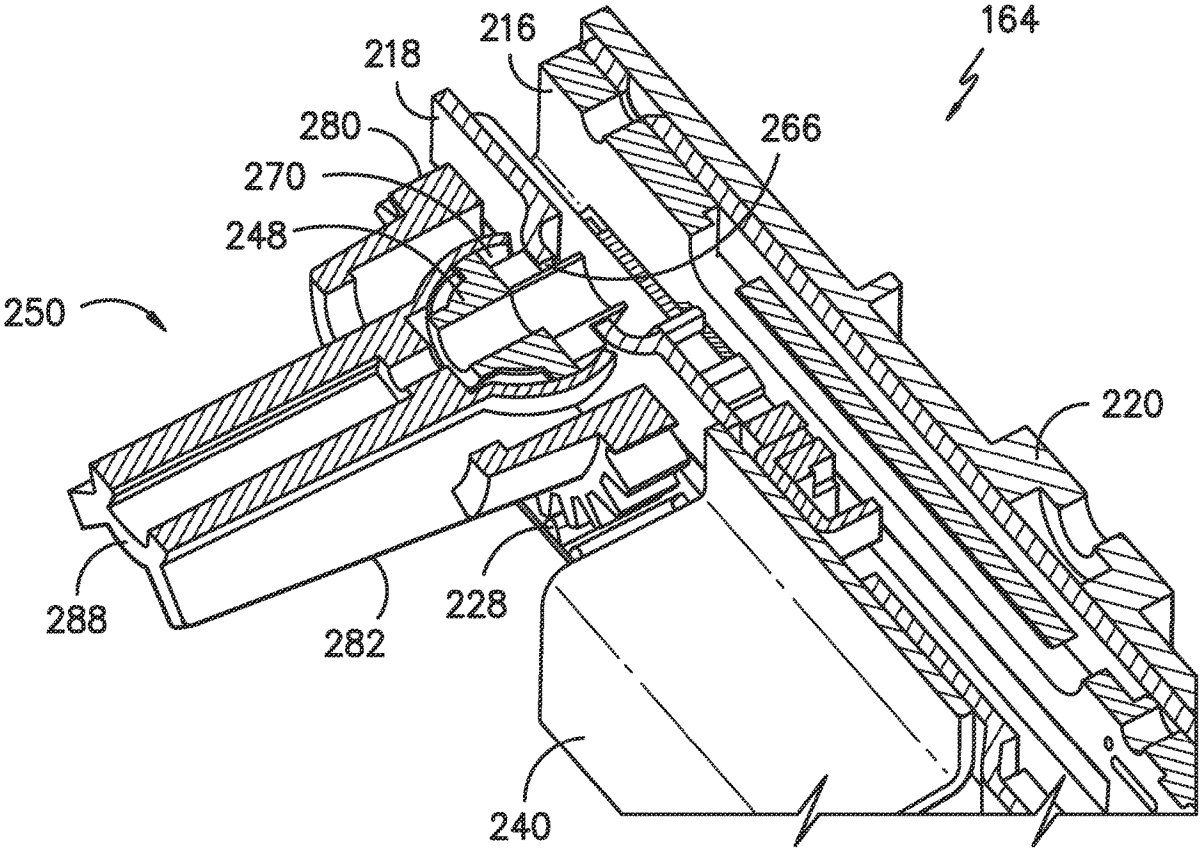
FIG. 11 provides a top perspective, cross-sectional view of an assembled pinion gear assembly and drawer slide assembly of the exemplary refrigerator appliance of FIG. 1.
Figure 12:
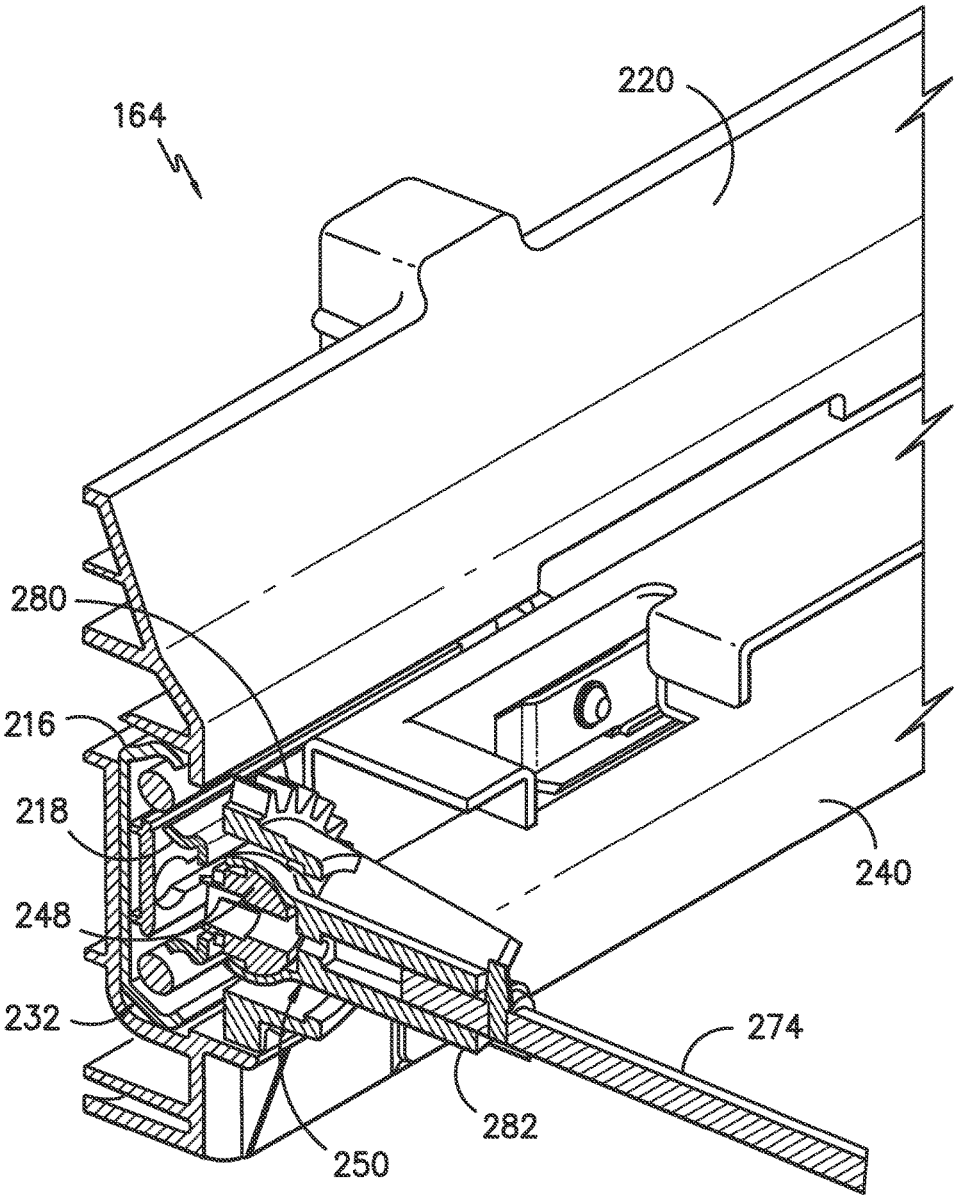
FIG. 12 provides a rear perspective, cross-sectional view of an assembled pinion gear assembly and drawer slide assembly of the exemplary refrigerator appliance of FIG. 1.
Figure 13:
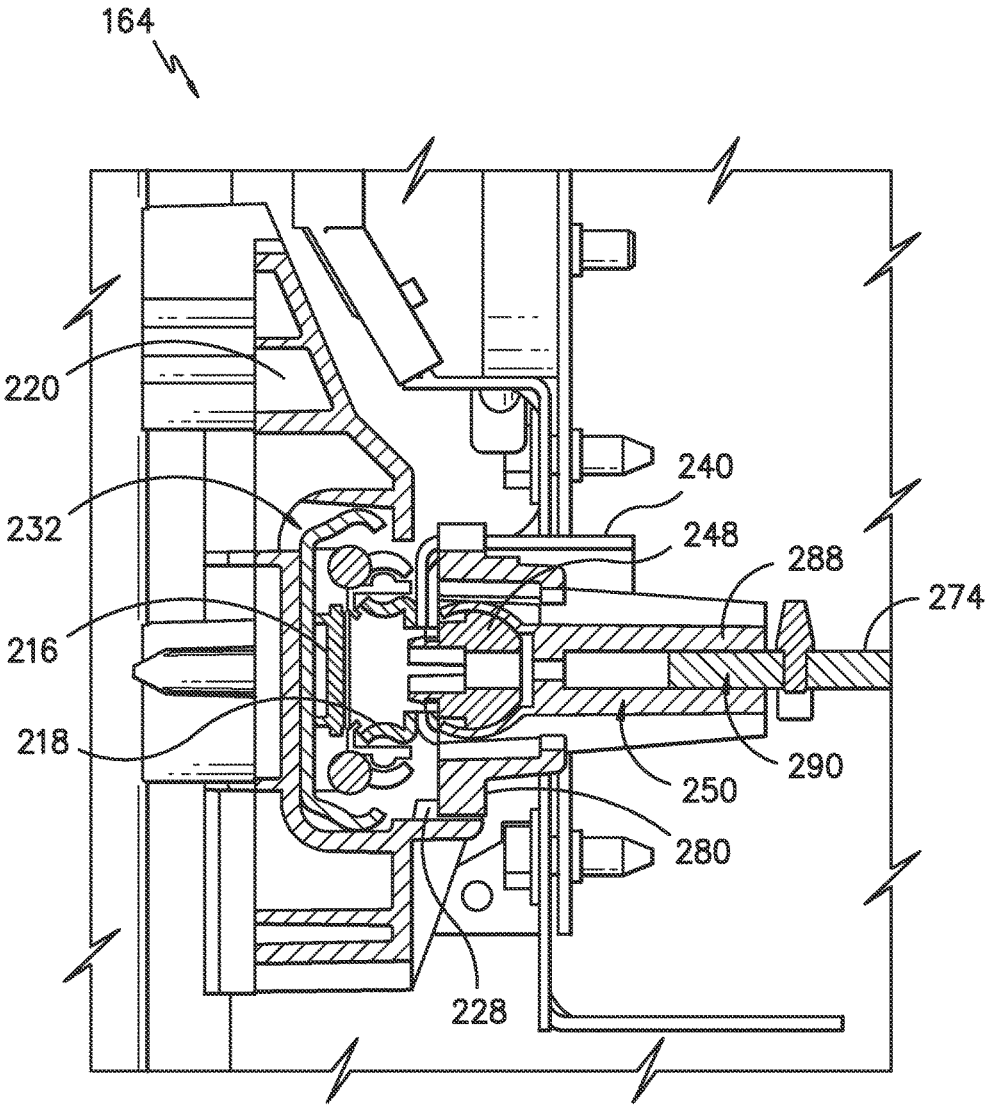
FIG. 13 provides a rear perspective, cross-sectional view of an assembled pinion gear assembly and drawer slide assembly of the exemplary refrigerator appliance of FIG. 1.
Figure 14:
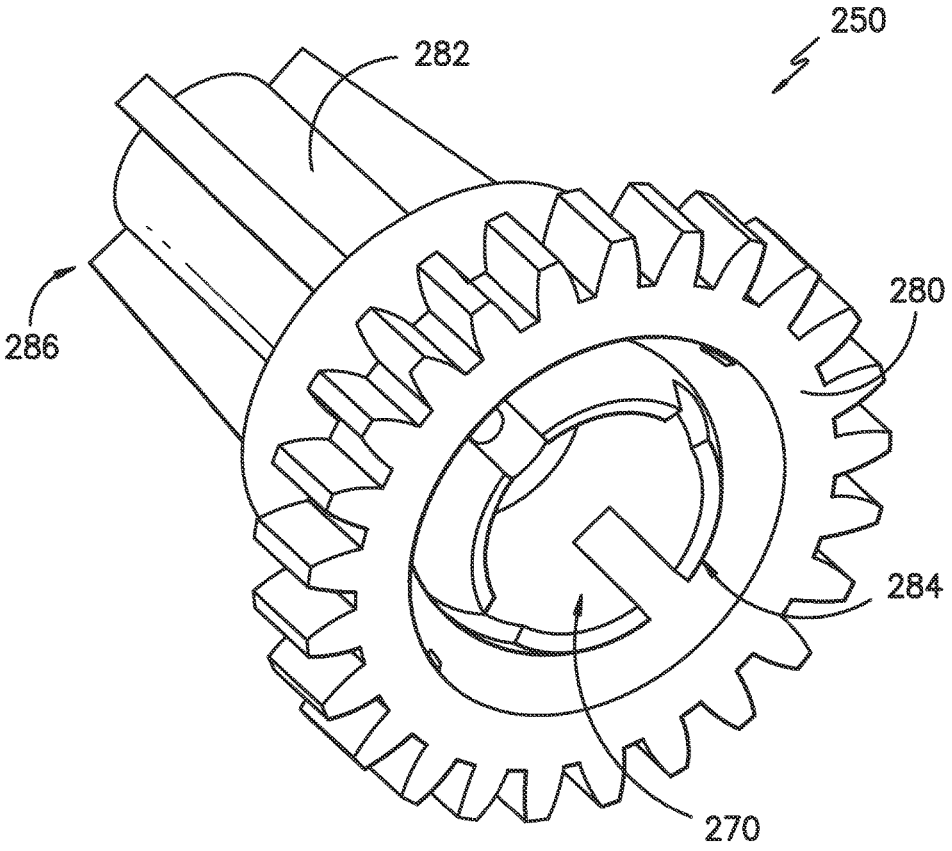
FIG. 14 provides a perspective view of the pinion gear from the drawer slide assembly of the exemplary refrigerator appliance of FIG. 1.
Figure 15:
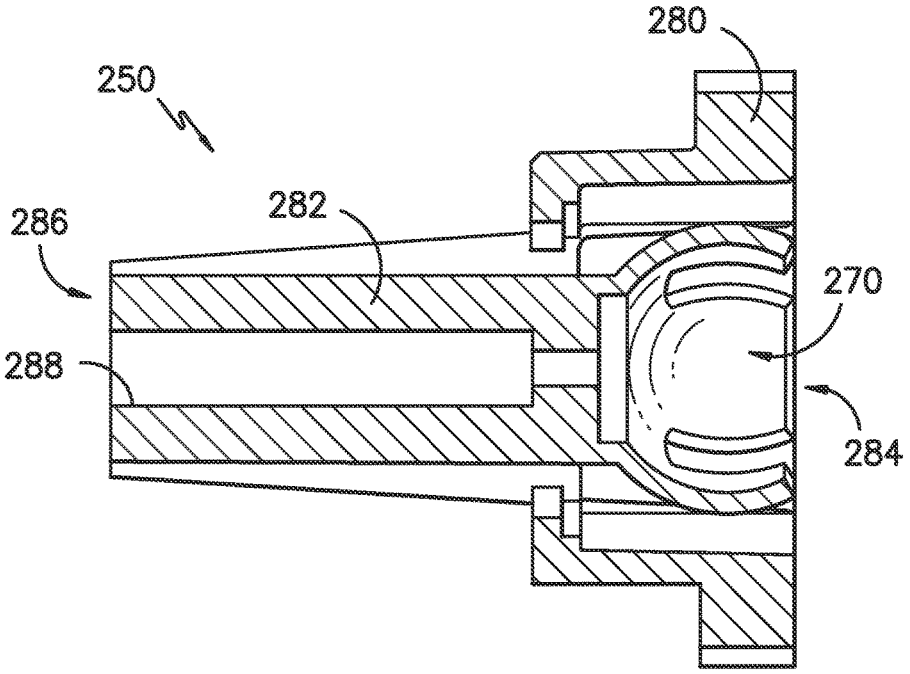
FIG. 15 provides a cross-sectional view of the pinion gear from the drawer slide assembly of the exemplary refrigerator appliance of FIG. 1.
Figure 16:
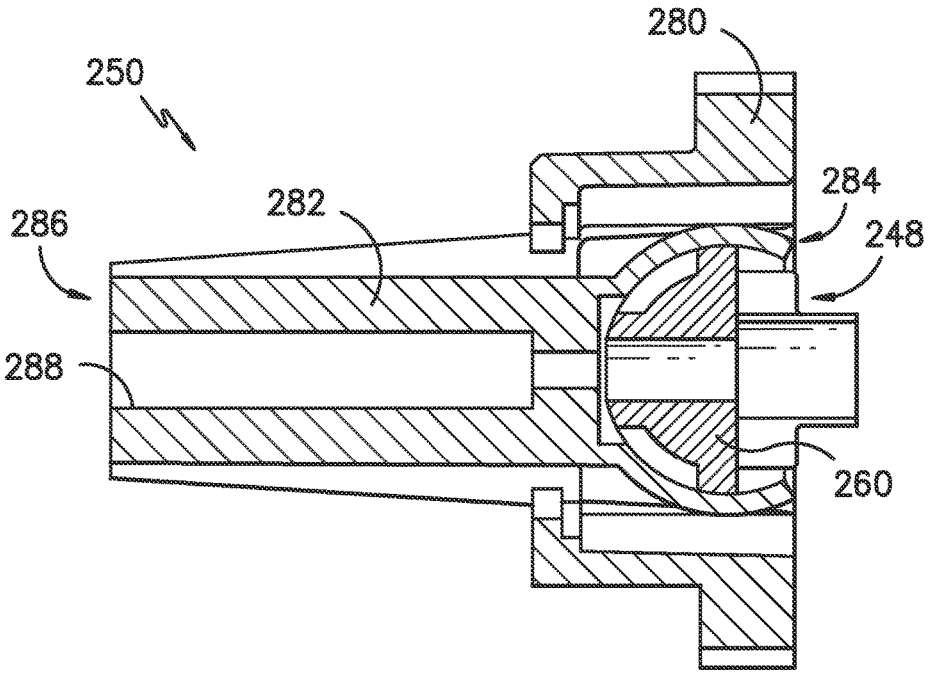
FIG. 16 provides a cross-sectional view of an assembled pinion gear and pinion base from the drawer slide assembly of the exemplary refrigerator appliance of FIG. 1.
Figure 17:
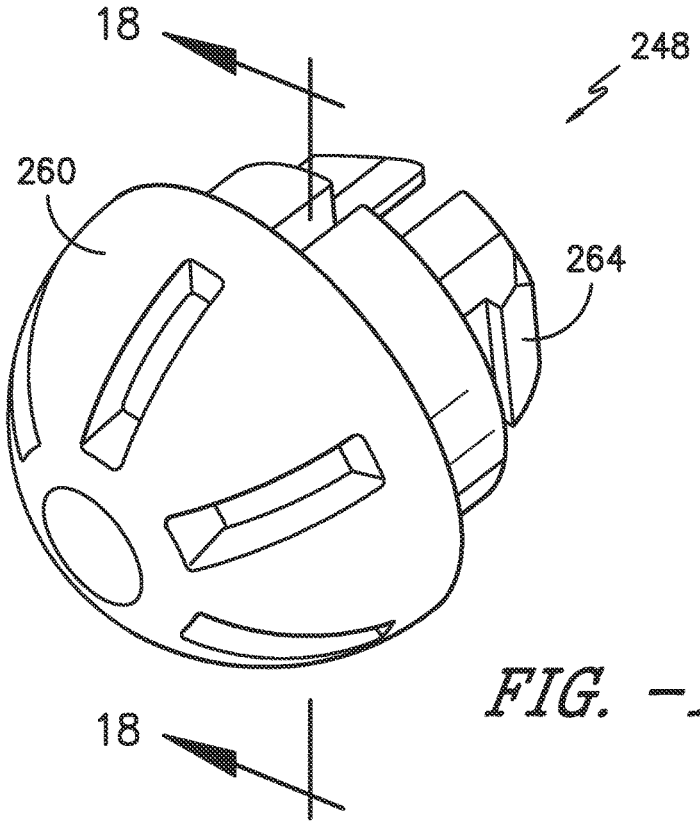
FIG. 17 provides a perspective view of the pinion base from the drawer slide assembly of the exemplary refrigerator appliance of FIG. 1.
Figure 18:
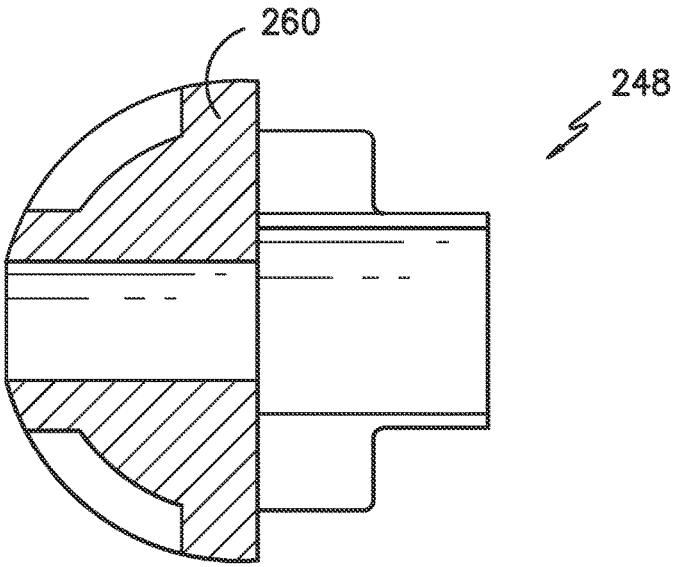
FIG. 18 provides a cross-sectional view of the pinion base from the drawer slide assembly of the exemplary refrigerator appliance of FIG. 1.

Referring now to FIGS. 5 through 18, freezer drawer 104 in accordance with an exemplary embodiment of the present subject matter will be described. FIGS. 5 and 6 provide perspective views of the assembled freezer drawer 104 and drawer slide assemblies 164, 166. FIGS. 7 through 9 provide exploded views of freezer drawer 104 and drawer slide assemblies 164, 166 (FIG. 7), first drawer slide assembly 164 (FIG. 8), and second drawer slide assembly 166 (FIG. 9). FIGS. 10 through 12 provide exploded (FIG. 10) and assembled (FIGS. 11 through 13) cross-sectional views of first pinion gear assembly 244. FIGS. 14 through 18 provide perspective and cross-sectional views of pinion gear assemblies 244, 246.

As shown in the illustrated embodiments, freezer drawer 104 may include first drawer slide assembly 164 and second drawer slide assembly 166 for moving freezer drawer 104 into and out of the freezer chamber 124. In this regard, as best shown in FIG. 7, each slide assembly 164, 166 may include a base 216 and one or more slide members 218 that move linearly into and out of slide base 216 via a suitable bearing arrangement. In an alternative embodiment, multiple slide members 218 may telescope relative to each other.

A first support 220 and a second support 222 may be configured for receiving drawer slide assemblies 164, 166 which are mounted on opposing sides of freezer drawer 104. In this regard, freezer chamber 124 may have a first sidewall 224 and a second sidewall 226. First support 220 may be mounted to the first sidewall 224 and include a first geared rack 228. Similarly, second support 222 may be mounted to the second sidewall 226 and include a second geared rack 230. Each of the geared racks 228, 230 may include an upper surface having a plurality of gear teeth defined thereon. As best shown in FIG. 7, base 216 of each slide assembly 164, 166 may be mounted to first support 220 or second support 222.

First support 220 and second support 222 may be constructed from any suitably rigid material. For example, first support 220 and second support 222 may be constructed of steel or injection molded plastic and attached to the first sidewall 224 and second sidewall 226 using any suitable mechanical fastener, such as screws, bolts, rivets, etc. Alternatively, first support 220 and second support 222 may be integrally formed with first sidewall 224 and second sidewall 226 or may be welded thereto. Similarly, first geared rack 228 and second geared rack 230 may be formed as a separate piece of metal, plastic, or other suitably rigid material and may be fastened to the first support 220 and second support 222, respectively. Alternatively, first geared rack 228 and second geared rack 230 may be formed as a unitary, integral piece with the first support 220 and second support 222, respectively, e.g., by injection molding.

Drawer slide assemblies 164, 166 may be fixed within freezer chamber 124 in any suitable manner. For example, fasteners (e.g., screws or bolts) may secure drawer slide assemblies 164, 166 to first and second supports 220, 222, or directly to cabinet 108. Similarly, glue, snap-fit mechanisms, interference-fit mechanisms, or any suitable combination thereof may secure drawer slide assemblies 164, 166 within freezer chamber 124. Alternatively, drawer slide assemblies 164, 166 may be integrally molded to cabinet 108 within freezer chamber 124. According to the illustrated embodiment, drawer slide assemblies 164, 166 may be secured to first and second supports 220, 222 on opposing sidewalls of cabinet 108 using mechanical fasteners.

According to the illustrated embodiment, first support 220 and second support 222 define a recess 232 that is configured to receive the slide base 216, which may be snapped in place or attached using mechanical fasteners, e.g., bolts. First geared rack 228 and the second geared rack 230 may be disposed below first drawer slide assembly 164 and second drawer slide assembly 166, respectively. Recess 232 may be deep enough to allow the slide base 216 of the drawer slide assemblies 164, 166 to sit flush with a surface of the first support 220 and second support 222. In this manner, a pinion gear (discussed in detail below), when attached to the slide member 218, may be aligned along the lateral direction L with the first geared rack 228 or second geared rack 230, respectively.

Drawer slide assemblies 164, 166 may be mounted to front panel 130 of freezer drawer 104 such that the freezer drawer 104 may be moved into and out of the freezer chamber 124 along the transverse direction T, relative to first support 220 and second support 222. More specifically, each of first drawer slide assembly 164 and second drawer slide assembly 166 may be attached at a first end 234 to front panel 130 and may extend from the front panel 130 in a substantially orthogonal direction to a distal second end 236.

As described above, first drawer slide assembly 164 and second drawer slide assembly 166 may be connected directly to front panel 130. By contrast, in the illustrated embodiment, first drawer slide assembly 164 and second drawer slide assembly 166 may be connected to front panel 130 by a first slide support bracket 240 and a second slide support bracket 242. First slide support bracket 240 and second slide support bracket 242 may be attached at opposite lateral sides of front panel 130 of freezer drawer 104 and connect to first slide support bracket 240 and second slide support bracket 242, respectively. The slide support brackets 240, 242 may be may of a rigid material, such as metal, and may connected to front panel 130 using mechanical fasteners, e.g., rivets or bolts. The slide support brackets may provide additional structural support to the freezer drawer 104.

Drawer slide assemblies 164, 166 may be positioned adjacent and parallel to the first support 220 and second support 222, respectively. In this manner, freezer drawer 104 may be disposed within the freezer chamber 124 (i.e., the retracted position) when in a closed position and freezer drawer 104 may slide out such that it is at least partially disposed outside freezer chamber 124 when in an open position (i.e., the extended position). One skilled in the art will appreciate that other mechanisms can be used to manipulate freezer drawer 104 within the freezer chamber 124 of refrigerator appliance 100.

Notably, as described briefly above, off-center pulling on handle 180 of freezer drawer 104 can cause freezer drawer 104 to have a tendency to rotate slightly as it moves into and out of freezer chamber 124. This rotation results in misalignment between the sides of freezer drawer 104, often referred to as "racking" Racking can cause freezer drawer 104 to bind within freezer chamber 124 such that is it is either very difficult to move or will not move at all. Moreover, this misalignment of freezer drawer 104 may result in an improper seal between cabinet 108 and freezer drawer 104 when in the closed position.

To minimize racking of freezer drawer 104, first drawer slide assembly 164 and second drawer slide assembly 166 may be synchronized by an anti-racking system to prevent them from sliding at different rates, and thus always keeping the freezer drawer 104 aligned with freezer chamber 124. According to the illustrated embodiment, in order to synchronize the movements of first drawer slide assembly 164 and second drawer slide assembly 166, freezer drawer 104 may include a pinion and connecting rod configuration. As described below, pinion gears may be attached to each of the drawer slide assemblies 264, 266 and may be joined by a connecting rod that spans the width of freezer drawer 104. In this manner, as freezer drawer 104 is moved into and out of the freezer chamber 124, an off-center pulling force exerted primarily on the first slide assembly causes the first pinion gear to simultaneously rotate the connecting rod and transfer the pulling force to the second pinion gear. Therefore, even when the freezer drawer 104 is pulled with an off-center force, first drawer slide assembly 164 and second drawer slide assembly 166 move in unison, as does the entire freezer drawer 104.

According to the illustrated embodiment, a first pinion gear assembly 244 and a second pinion gear assembly 246 are connected to the first drawer slide assembly 164 and the second drawer slide assembly 166, respectively. First pinion gear assembly 244, may include, for example, a first pinion base 248 and a first pinion gear 250. The first pinion base 248 may be attached to second end 236 of first drawer slide assembly 164. It should be understood that the second drawer slide assembly 166 may be similarly constructed, having a second pinion base 252 and a second pinion gear 254 attached to second end 236 of second drawer slide assembly 166.

First pinion base 160 and second pinion base 252 may define a first pinion stud 260 and a second pinion stud 262, respectively. Pinion studs 260, 262 may be any member protruding from pinion bases 248, 252 that is configured to receive the respective first pinion gear 250 or second pinion gear 254. According to the illustrated embodiment, each pinion stud 260, 262 is a spherical ball joint that extends from pinion bases 248, 252, respectively. The spherical ball joint may be a solid sphere or any other shape sufficient to attach pinion gears 250, 254 and pinion bases 248, 252 together. The shape of each pinion stud 260, 262 should allow rotation of pinion gears 250, 254 relative to pinion bases 248, 252 about an axis parallel to the lateral direction L. In addition, the shape of each pinion stud 260, 262 should allow rotation of pinion gears 250, 254 relative to pinion bases 248, 252 about an axis parallel to at least one of vertical direction V and transverse direction T.

First pinion base 248 and second pinion base 252 may be mounted to the respective first drawer slide assembly 164 or second drawer slide assembly 166 by resilient locking tabs 264 that may be snapped into a receiving hole 266 on the respective first drawer slide assembly 164 or second drawer slide assembly 166. In this regard, locking tabs 264 may protrude from first pinion base 248 and second pinion base 252 in a cantilevered manner, such that they flex when inserted into receiving hole 266 and snap securely in place when fully inserted. Alternatively, first pinion base 248 and second pinion base 252 may be connected to the respective first drawer slide assembly 164 or second drawer slide assembly 166 using any suitable attachment means, such as mechanical fasteners.

First pinion gear 250 may engage first geared rack 228 and define a first socket 270 that is configured to receive first pinion stud 260 and rotatably mount first pinion gear 250 to first pinion base 248. Similarly, second pinion gear 254 may engage second geared rack 230 and define a second socket 272 that is configured to receive second pinion stud 262 and rotatably mount second pinion gear 254 to second pinion base 252. Each socket 270, 272 may include a plurality of arcuate clips that are configured to snap onto the respective first pinion stud 260 or second pinion stud 262. One skilled in the art will appreciate that other socket configurations are possible. In this manner, pinion gear assemblies 244, 246 are mounted to slide member 218 and pinion gears 250, 254 are in geared engagement with geared racks 228, 230 so as to rotate as front panel 130 (and attached slide member 218) of freezer drawer 104 are moved into and out of freezer chamber 124.

A connecting rod 274 connects first pinion gear 250 and second pinion gear 254 such that they share a rotational axis with connecting rod 274. More specifically, pinion gears 250, 254 and connecting rod 274 rotate about an axis A defined by connecting rod 274, such that pinion gears 250, 254 rotate in unison along their respective geared racks 228, 230. In this manner, a driving force generated at first pinion gear 250 from an off-center pulling force on the freezer drawer 104 is transmitted through the connecting rod 274 to second pinion gear 254 as the drawer door moves between an open and a closed position, and vice versa. In this manner, the force imbalance is "equalized" and the likelihood of freezer drawer 104 racking or binding in freezer chamber 124 is significantly reduced.

According to some embodiments, each of first pinion gear 250 and second pinion gear 254 may include a circular gear 280 surrounding a concentric, axially extending member 282. A first end 284 of the axial member 282 may define sockets 270, 272 while an opposite second end 286 of the axial member 282 defines a keyed hub 288. Notably, connecting rod 274 spans the entire lateral width of freezer drawer 104 and engages keyed hub 288 of pinion gears 250, 254 in a manner that ensures each pinion gear 250, 254 is securely positioned over the geared racks 228, 230. More specifically, connecting rod 274 has a first end 290 and an opposite second end 292, each of the first end 290 and second end 292 being configured for receipt into the respective keyed hub 288. The keyed hub 288 may be, for example, a square receiving hole defined in the center of second end 286 of axial members 282 configured to receive a square ends 290, 292 of connecting rod 274. In this manner, connecting rod 274 will rotate along with first pinion gear 250 and second pinion gear 254. Other shapes of the keyed hub 288 and ends 290, 292 of connecting rod 274 are also possible. For example, the ends 290, 292 of connecting rod 274 and the keyed hubs 288 may have any complementary multi-sided cross-sectional profile.

Although the illustrated embodiment describes freezer drawer 104 for use in freezer chamber 124 of refrigerator appliance 100, one skilled in the art will appreciate that freezer drawer 104 can be used in any suitable appliance. As an example, freezer drawer 104 may be used in refrigerator appliance 100 (FIG. 1) as one of drawers 136 (FIG. 2). In alternative exemplary embodiments, freezer drawer 104 may be used in oven appliances, dishwasher appliances, washing machine appliances, etc.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A drawer assembly for a consumer appliance, the consumer appliance defining a cabinet having a first sidewall and a second sidewall, the drawer assembly comprising:

a first support mounted to the first sidewall and comprising a first geared rack;

a second support mounted to the second sidewall and comprising a second geared rack;

a drawer door comprising a first drawer slide and a second drawer slide, a first end of each of the first drawer slide and the second drawer slide being attached to the drawer door;

a first pinion base attached at a second end of the first drawer slide and defining a first pinion stud, and a second pinion base attached at a second end of the second drawer slide and defining a second pinion stud;

a first pinion gear engaging the first geared rack and defining a first end and an opposing second end, the first pinion gear further defining a first socket that is positioned at the first end and is configured to receive the first pinion stud and rotatably mount the first pinion gear to the first pinion base, and a second pinion gear engaging the second geared rack and defining a first end and an opposing second end, the second pinion gear further defining a second socket that is positioned at the first end and is configured to receive the second pinion stud and rotatably mount the second pinion gear to the second pinion base; and a connecting rod connecting the second end of first pinion gear and the second end of second pinion gear, such that driving force generated at the first pinion gear from an off-center pulling force on the drawer door is transmitted through the connecting rod to the second pinion gear as the drawer door moves between an open and a closed position.

2. The drawer assembly of claim 1, wherein the drawer door further comprises a first slide support bracket and a second slide support bracket attached at opposite lateral sides of the drawer door, the first slide support bracket connected to the first drawer slide and the second slide support bracket connected to the second drawer slide.

3. The drawer assembly of claim 1, wherein each of the first pinion gear and the second pinion gear comprises a keyed hub and the connecting rod has opposite ends, each opposite end configured to be received into the respective keyed hub.

4. The drawer assembly of claim 1, wherein the pinion stud is a spherical ball joint.

5. The drawer assembly of claim 1, wherein the first geared rack and the second geared rack are disposed below the first drawer slide and the second drawer slide.

6. The drawer assembly of claim 1, wherein the first geared rack is formed as a unitary and integral piece with the first support and the second geared rack is formed as a unitary and integral piece with the second support.

7. The drawer assembly of claim 1, wherein each of the first pinion base and the second pinion base is mounted to the respective first drawer slide or second drawer slide by a resilient locking tab that is snapped into a receiving hole on the respective first drawer slide or second drawer slide.

8. The drawer assembly of claim 1, wherein each of the first socket and the second socket defines a plurality of arcuate clips that are configured to snap onto the respective first pinion stud or second pinion stud.

9. The drawer assembly of claim 1, wherein the consumer appliance is a refrigerator appliance, and the drawer assembly is configured in a freezer compartment of the refrigerator appliance.

10. A consumer appliance, comprising:

a compartment having a first side and an opposite second side;

a first slide member configured on the first side of the compartment and a second slide member configured on the second side of the compartment;

a first gear rail configured adjacent the first slide member and a second gear rail configured adjacent the second slide member;

a drawer mounted to the first slide member and the second slide member for movement of the drawer into and out of the compartment;

a first gear assembly mounted to the first slide member and a second gear assembly mounted to the second slide member, each of the first gear assembly and the second gear assembly comprising a pinion base that is attached to the respective first slide member or second slide member and defines a pinion stud, and a pinion gear defining a first end and an opposite second end, the pinion gear further defining a socket positioned at the first end and being configured to receive the pinion stud such that the pinion gear is rotatably mounted to the pinion base, wherein each pinion gear engages the respective first gear rail or second gear rail and a cross bar is connected between the second end of the pinion gears such that driving force generated at the first gear assembly from an off-center pulling force on the drawer is transmitted through the cross bar to the second gear assembly.

11. The consumer appliance of claim 10, wherein the drawer further comprises a first slide support bracket attached to the first slide member and a second slide support bracket attached to the second slide member.

12. The consumer appliance of claim 10, wherein each pinion gear comprises a keyed hub and the cross bar has opposite ends, each opposite end configured to be received into the respective keyed hub.

13. The consumer appliance of claim 10, wherein the first gear rail and the second gear rail are disposed below the first slide member and the second slide member.

14. The consumer appliance of claim 10, wherein the first gear rail is formed as a unitary and integral piece with a first slide support bracket and the second gear rail is formed as a unitary and integral piece with a second slide support bracket.

15. The consumer appliance of claim 10, wherein the pinion base of each of the first gear assembly and the second gear assembly is mounted to the respective first slide member or second slide member by a resilient clip that is snapped into a receiving hole on the respective first slide member or second slide member.

16. The consumer appliance of claim 10, wherein each socket defines a plurality of arcuate clips that are configured to snap onto the respective pinion stud to prevent disassembly of the respective first gear assembly or second gear assembly.

17. The consumer appliance of claim 10, wherein the pinion stud is a spherical ball joint.

18. The consumer appliance of claim 10, wherein the consumer appliance is a refrigerator appliance and the drawer is configured in a freezer compartment of the refrigerator appliance.

19. A consumer appliance defining a vertical direction, a lateral direction, and a transverse direction, the vertical, lateral, and transverse directions being mutually perpendicular, the consumer appliance comprising:

a compartment having a first side portion and a second side portion spaced apart from each other along the lateral direction;

a first slide assembly base proximate the first side portion and comprising a first geared rack, and a second slide assembly base proximate the second side portion and comprising a second geared rack;

a drawer configured to provide access into the compartment, the drawer having a first slide assembly positioned proximate the first slide assembly base and a second slide assembly positioned proximate the second slide assembly base;

a first pinion gear assembly mounted to the first slide assembly and a second pinion gear assembly mounted to the second slide assembly, each of the first pinion gear assembly and the second pinion gear assembly comprising a pinion base that defines a spherical ball stud, and a pinion gear defining a socket that is configured to receive the spherical ball stud, wherein each pinion gear engages the respective first geared rack or second geared rack and a cross bar is connected between the pinion gears such that driving force generated at the first pinion gear assembly from an off-center pulling force on the drawer is transmitted through the cross bar to the second pinion gear assembly, and wherein the first slide assembly and the second slide assembly support the drawer such that the drawer is translatable along the transverse direction between an open position where it is disposed outside of the compartment and a closed position where it is disposed inside the compartment.

20. The consumer appliance of claim 19, wherein the pinion base of each of the first gear assembly and the second gear assembly is mounted to the respective first slide assembly or second slide assembly by a resilient clip that is snapped into a receiving hole on the respective first slide assembly or second slide assembly, and wherein each socket defines a plurality of arcuate clips that are configured to snap onto the respective spherical ball stud to prevent disassembly of the respective first pinion gear assembly or second pinion gear assembly.

* * * * *